US008714281B2

(12) United States Patent
Chen

(10) Patent No.: US 8,714,281 B2
(45) **Date of Patent: *May 6, 2014**

(54) BIDIRECTIONAL CROSS AIRFLOW MACHINE TOOL

(75) Inventor: Bach Pangho Chen, Claremont, CA (US)

(73) Assignee: X'Pole Precision Tools Inc., Chung-Li, Taoyuan County (TW)

( * ) Notice: Subject to any disclaimer, the term of this patent is extended or adjusted under 35 U.S.C. 154(b) by 236 days.

This patent is subject to a terminal disclaimer.

(21) Appl. No.: 13/222,960

(22) Filed: Aug. 31, 2011

(65) Prior Publication Data

US 2013/0048328 A1 Feb. 28, 2013

(51) Int. Cl.
*E21B 10/12* (2006.01)

(52) U.S. Cl.
USPC ..... 173/213; 173/216; 173/218; 451/357

(58) Field of Classification Search
USPC ..... 173/213; 451/7, 357, 359, 488, 449
See application file for complete search history.

(56) References Cited

U.S. PATENT DOCUMENTS 5,018,314 A * 5/1991 Fushiya et al. ..... 451/357
5,372,489 A * 12/1994 Matsuda et al. ..... 418/13
5,947,804 A * 9/1999 Fukinuki et al. ..... 451/357
8,226,454 B2 * 7/2012 Chen ..... 451/7
2011/0136419 A1 * 6/2011 Chen ..... 451/456

FOREIGN PATENT DOCUMENTS

| | | |
|---|---|---|
| CN | 2887526 Y | 4/2007 |
| CN | 201611818 U | 10/2010 |
| TW | M261316 | 4/2005 |
| TW | M288839 | 3/2006 |

* cited by examiner

*Primary Examiner* — Thanh Truong
*Assistant Examiner* — Nathaniel Chukwurah
(74) *Attorney, Agent, or Firm* — Muncy, Geissler, Olds & Lowe, P.C.

(57) ABSTRACT

A bidirectional cross airflow machine tool includes a housing chamber to hold a tool spindle and air inlets and air outlets at two sides thereof. The tool spindle is coupled with a balance weight member which includes a first balance weight portion and a second balance weight portion arranged in an up and down fashion so that the tool spindle generates eccentric rotation against the machine tool. The first and second balance weight portions respectively have a first vane set and a second vane set. The first vane set sucks air via the air inlets at one side of the machine tool during rotation of the tool spindle. The air is transmitted from the first vane set to the first and second balance weight portions, and then is discharged via the second vane set through the air outlets at another side of the machine tool to form cross cooling airflow.

7 Claims, 4 Drawing Sheets

BIDIRECTIONAL CROSS AIRFLOW MACHINE TOOL

FIELD OF THE INVENTION

The present invention relates to a bidirectional cross airflow machine tool and particularly to a machine tool capable of generating bidirectional cross airflow inside during operation to disperse heat.

BACKGROUND OF THE INVENTION

Techniques of machine tools such as grinder are known in industries. For instance, R.O.C. patent Nos. M261316 and M288839 respectively disclose a machine tool that mainly include a body, a motor located in the body and a tool spindle driven by the motor to rotate. The tool spindle is coupled with two balance weights to rotate eccentrically. The two balance weights also are coupled with an action member. When the motor is started, the tool spindle is driven to rotate eccentrically. Through the two balance weights, the action member is driven to perform fabrication processes on a workpiece. However, the motor easily generates and accumulates heat during operation of the machine tool, and becomes overheated that could affect operation duration of the machine tool. As a result, durability of the machine tool also is impacted.

To remedy the aforesaid problem improving techniques have been proposed. For instance, China patent No. CN2887526 discloses a technique by forming an air inlet and an air outlet at corresponding locations of the body of a machine tool. When the motor is operating the air inlet sucks in external air and internal heat is discharged through the air outlet to cool the motor so that the problem of heat accumulation of the motor can be overcome. However, the two balance weights and action member also generate a great amount of heat during operation. The prior art CN2887526 can merely disperse heat for the motor without cooling the two balance weights. Moreover, during operation dusts are easily carried by the dispersed air to enter the motor. Hence durability of the machine tool still is a big concern.

Another improvement is disclosed in China patent No. CN201611818 in which a circular grinder has an air inlet formed at a location corresponding to a balance weight. The balance weight has an air fan to suck air through the air inlet and transmit the air downwards, and the air is then discharged via a gap between the circular grinder and a grinding disk. Such a design not only can disperse heat, also can prevent dusts from entering the motor.

However, not all machine tools respectively have a gap at the lower side to serve as an outlet of hot air. For instance, an orbital sander can suck external cooling air, but still cannot discharge internal hot air outside. Thus cooling effect is not desirable.

SUMMARY OF THE INVENTION

The primary object of the present invention is to solve the aforesaid disadvantages to reduce internal temperature of machine tools and disperse heat effectively.

To achieve the foregoing object the invention provides a bidirectional cross airflow machine tool that includes a machine tool and a radiator. The machine tool has air inlets and air outlets on two sides arranged in an up and down manner, and also a housing chamber to hold a tool spindle. The tool spindle is coupled with a balance weight member which includes a first balance weight portion and a second balance weight portion arranged in an up and down manner so that the tool spindle can generate eccentric rotation against the machine tool. The radiator is located on the balance weight member and rotates synchronously with the tool spindle, and has a first vane set located on the first balance weight portion and a second vane set located on the second balance weight portion. The first vane set sucks air via the air inlets at one side of the machine tool while the tool spindle is rotating. The air is transmitted from the first vane set to the first and second balance weight portions, and then is discharged via the second vane set through the air outlets at another side of the machine tool to form cross cooling airflow.

In an embodiment of the invention, the first vane set includes a plurality of air intake vanes located outside the first balance weight portion. The air intake vanes are respectively formed in an arched profile to transmit the air from the first balance weight portion to the second balance weight portion. The second vane set includes a plurality of air discharge vanes located outside the second balance weight portion. The air discharge vanes are respectively formed in a flat shape to transmit the air from the second balance weight portion to the air outlets. The first and second vane sets have respectively a first coupling portion and a second coupling portion to form coupling and positioning. The first and second coupling portions are respectively a notch and a lug. The first vane set is formed at an elevation the same as that of the air inlet, while the second vane set is formed at another elevation the same as that of the air outlet.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
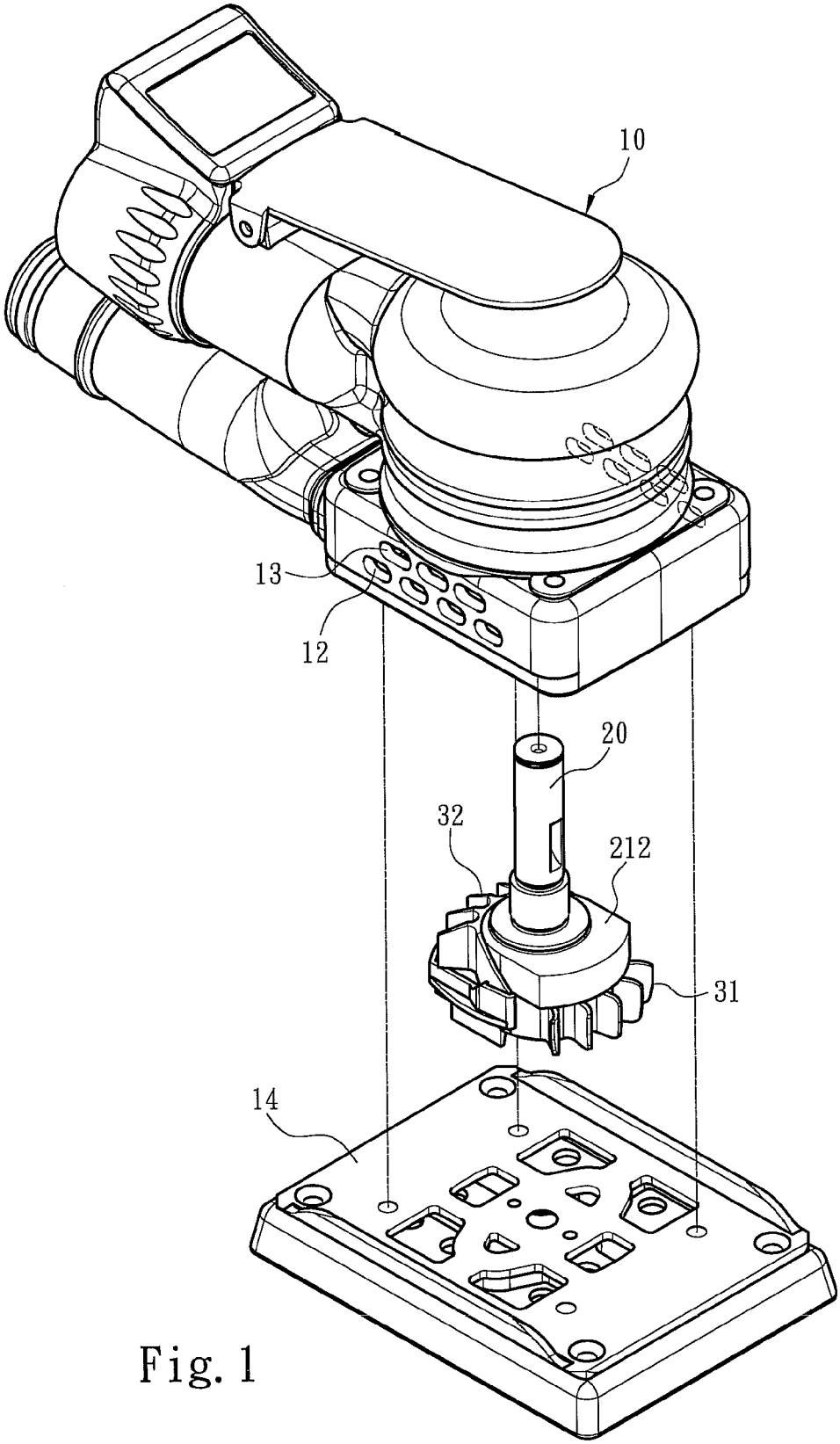
FIG. 1 is an exploded view of the invention.
Figure 2:
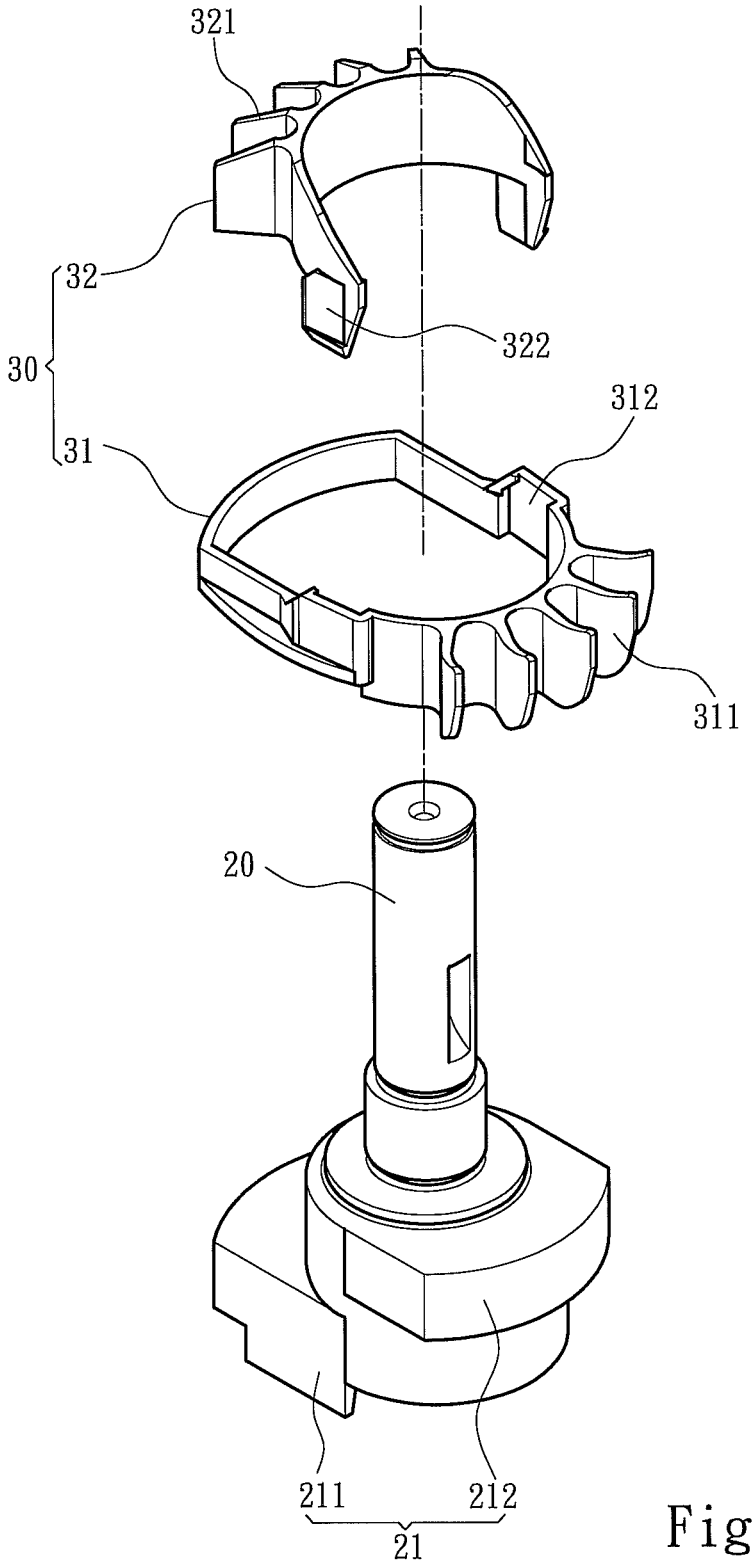
FIG. 2 is another exploded view of the invention.

Please refer to FIGS. 1 and 2, the present invention aims to provide a bidirectional cross airflow machine tool that mainly includes a machine tool 10 and a radiator 30. The machine tool 10 can be an electric tool or a pneumatic tool. It has a housing chamber 11 to hold a tool spindle 20 which is coupled with a driving device (not shown in the drawings), such as a motor, to be driven for rotating. The tool spindle 20 is coupled with a balance weight member 21 on a lower side that includes a first balance weight portion 211 and a second balance weight portion 212 arranged in an up and down manner. As shown in the drawings, the first balance weight portion 211 is located below the second balance weight portion 212. Through the balance weight member 21, the tool spindle 20 can generate eccentric rotation against the machine tool 10. In addition, a rectangular workpiece 14 may be provided below the machine tool 10. The machine tool 10 also has air inlets 12 and air outlets 13 at two sides that are arranged in an up and down manner. In an embodiment of the invention the air inlets 12 are located below the air outlets 13.

The radiator 30 is located on the balance weight member 21 and rotates synchronously and eccentrically against the tool spindle 20. The radiator 30 includes a first vane set 31 located on the first balance weight portion 211 and a second vane set 32 located on the second balance weight portion 212. The first and second vane sets 31 and 32 have respectively a first coupling portion 312 and a second coupling portion 322 for coupling and positioning. As shown in the drawings, the first and second coupling portions 312 and 322 are respectively a notch and a lug. In addition, the first vane set 31 is formed at an elevation the same as that of the air inlet 12 and includes a plurality of air intake vanes 311 arranged outside the first balance weight portion 211. The air intake vanes 311 are respectively formed in an arched profile. The second vane set 32 is formed at an elevation the same as that of the air outlet 13 and includes a plurality of air discharge vanes 321 arranged outside the second balance weight portion 212. The air discharge vanes 321 are respectively formed in a flat shape. Thus forms the main structure of the invention.

Figure 3A:
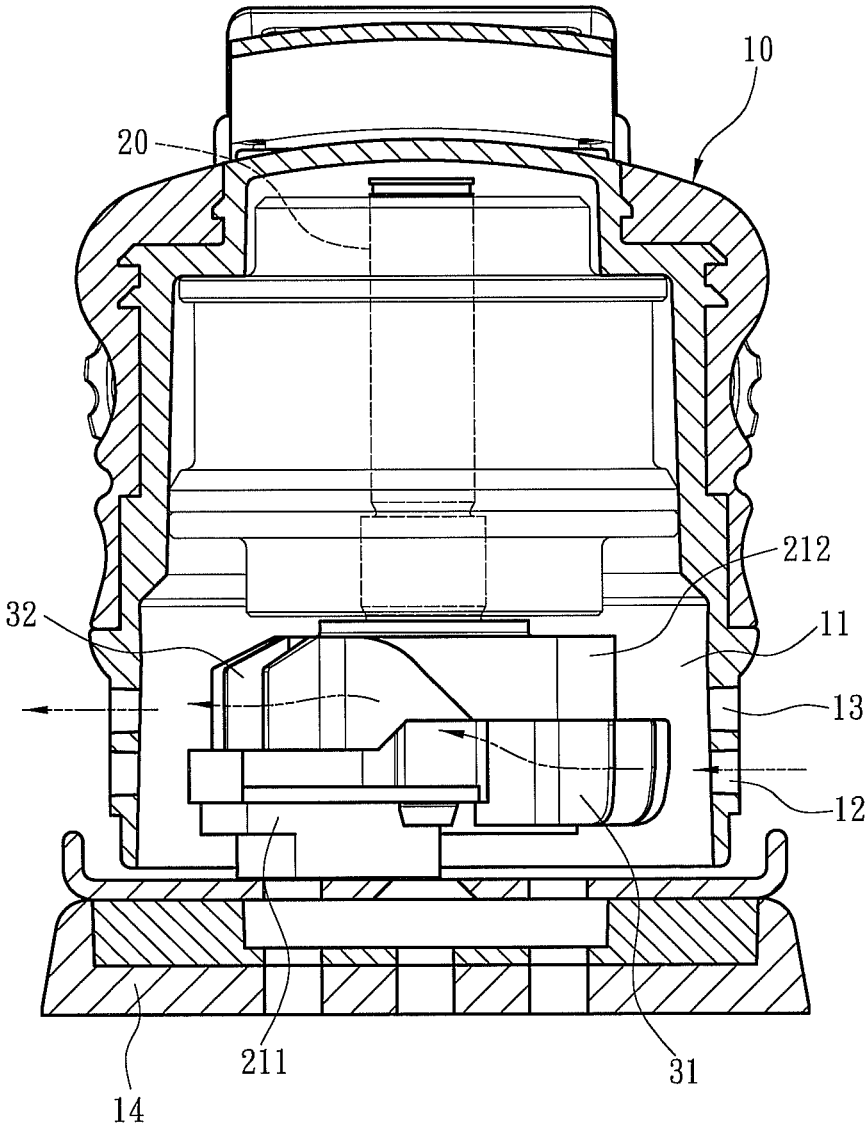
FIGS. 3A and 3B are schematic views of an embodiment of the invention in use conditions.
Figure 3B:
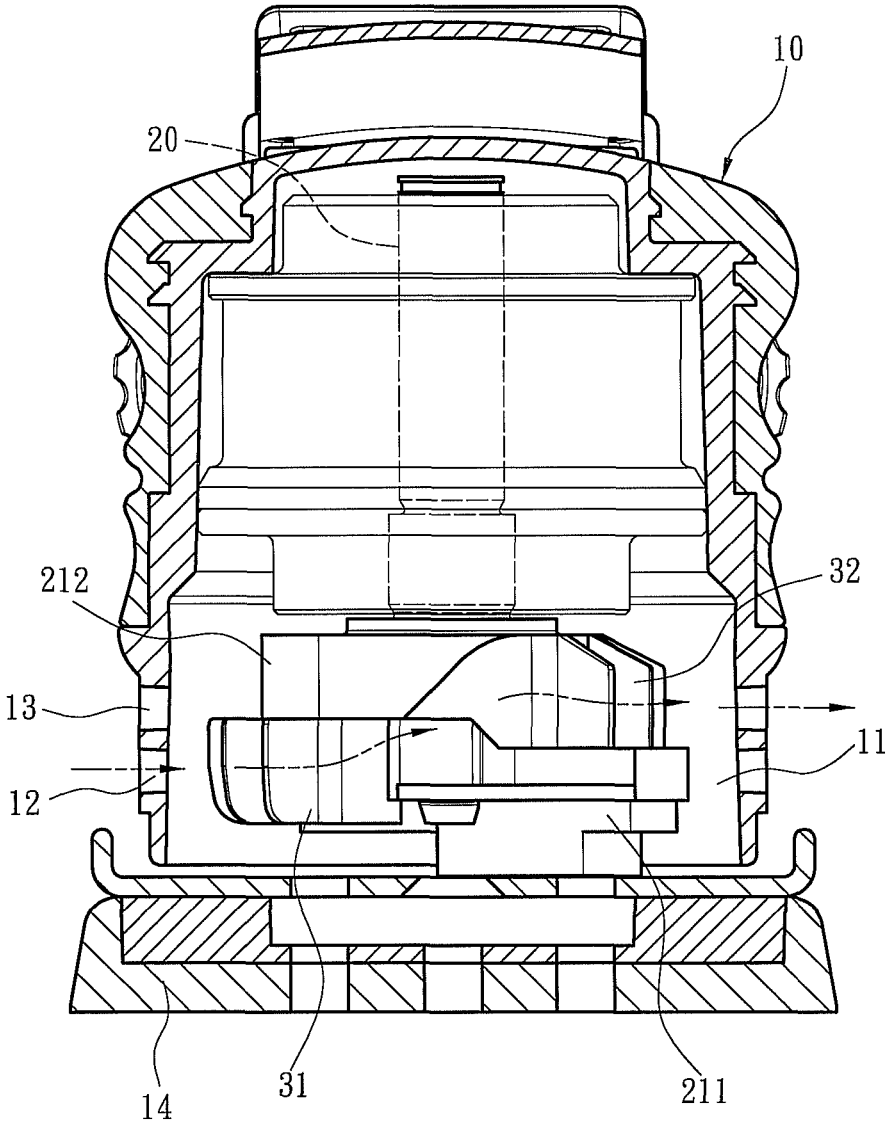

Referring to FIGS. 3A and 3B, when the machine tool 10 is in operation, the tool spindle 20 drives the first balance weight portion 211 and second balance weight portion 212 to rotate, and the first and second vane sets 31 and 32 also rotate accordingly. Since the air intake vanes 311 of the first vane set 31 are respectively formed in the arched profile, external cooling air can be sucked in via the air inlets 12 at the lower right side shown in the drawings while the first vane set 31 is rotating to transmit the air to the balance weight member 21 where temperature is highest to absorb the heat of the balance weight member 21. As the air discharge vanes 321 of the second vane set 32 are respectively formed in a flat shape and formed at a width gradually shrunk from the inner side towards the outer side, moving speed at the outer side of the air discharge vane 321 is faster than that at the inner side thereof so that air flowing speed at the outer area is faster than that at the inner area. According Bernoulli Effect, the pressure in the area where airflow speed is faster is lower than in the area where the airflow speed is slower. Hence the second vane set 32 can discharge the hot air having absorbed the heat from the balance weight member 21 via the air outlets 13 at the upper left side shown in the drawings (referring to FIG. 3A). Meanwhile, the external cooling air also can be sucked in through the air inlets 12 at the lower left side shown in the drawings via the first vane set 31 and become hot air through the balance weight member 21, and then is discharged through the air outlets 13 at the upper right side shown in the drawings via the second vane set 32. Thus an X-shaped bidirectional cross airflow is formed to continuously suck the cooling air and discharged the hot air (referring to FIG. 3B).

As a conclusion, the present invention mainly provides the air inlets 12 and air outlets 13 at two sides of the machine tool 10 in an up and down manner, and also provides the first vane set 31 on the first balance weight portion 211 and second vane set 32 on the second balance weight portion 212 so that the first vane set 31 sucks air via the air inlets 12 at one side of the machine tool 10 during rotation of the tool spindle 20, and the air is conducted from the first vane set 31 to the first and second balance weight portions 211 and 212 and then is discharged through the air outlets 13 at another side of the machine tool 10. Thus a cooling cross airflow is generated continuously to form an effective cooling system. Dust generated during operation of the machine tool 10 can also be prevented from entering the motor or control circuits of the machine tool 10 without forming damages to the tool.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A bidirectional cross airflow machine tool, comprising:

a machine tool including a housing chamber to hold a tool spindle, the tool spindle being coupled with a balance weight member which includes a first balance weight portion and a second balance weight portion arranged in an up and down manner so that the tool spindle generates eccentric rotation against the machine tool, the machine tool also including air inlets and air outlets at two sides in an up and down fashion; and a radiator which is located on the balance weight member and rotates synchronously with the tool spindle including a first vane set located on the first balance weight portion and a second vane set located on the second balance weight portion, the first vane set sucking air via the air inlets at one side of the machine tool during rotation of the tool spindle, the air being conducted from the first vane set to the first balance weight portion and the second balance weight portion and then being discharged via the second vane set through the air outlets at another side of the machine tool to form cross cooling airflow.

2. The bidirectional cross airflow machine tool of claim 1, wherein the first vane set includes a plurality of air intake vanes located outside the first balance weight portion, the air intake vanes respectively being formed in an arched profile to transmit the air from the first balance weight portion to the second balance weight portion.

3. The bidirectional cross airflow machine tool of claim 1, wherein the second vane set includes a plurality of air discharge vanes located outside the second balance weight portion, the air discharge vanes respectively being formed in a flat shape to transmit the air from the second balance weight portion to the air outlets.

4. The bidirectional cross airflow machine tool of claim 1, wherein the first vane set and the second vane set include respectively a first coupling portion and a second coupling portion for coupling with each other and positioning.

5. The bidirectional cross airflow machine tool of claim 4, wherein the first coupling portion and the second coupling portion are respectively a notch and a lug.

6. The bidirectional cross airflow machine tool of claim 1, wherein the first vane set is formed at an elevation the same as that of the air inlet and the second vane set is formed at another elevation the same as that of the air outlet.

7. The bidirectional cross airflow machine tool of claim 1, wherein the machine tool further includes a rectangular workpiece.

* * * * *